US008878461B2

(12) United States Patent
Serebryanov et al.

(10) Patent No.: US 8,878,461 B2
(45) Date of Patent: Nov. 4, 2014

(54) LAMP FAILURE DETECTOR

(75) Inventors: Oleg Serebryanov, San Jose, CA (US); Alexander Goldin, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 701 days.

(21) Appl. No.: 13/174,608

(22) Filed: Jun. 30, 2011

(65) Prior Publication Data

US 2013/0002140 A1 Jan. 3, 2013

(51) Int. Cl.
*H05B 37/02* (2006.01)
*H05B 37/03* (2006.01)

(52) U.S. Cl.
CPC ..... *H05B 37/038* (2013.01)
USPC ..... 315/308; 315/307; 315/291

(58) Field of Classification Search
USPC ..... 315/291, 307–308, 312, 272–273, 227 R
See application file for complete search history.

(56) References Cited

U.S. PATENT DOCUMENTS

| | | | | |
|---|---|---|---|---|
| 4,398,130 | A | 8/1983 | McFayden et al. | |
| 5,694,007 | A | 12/1997 | Chen | |
| 5,930,126 | A * | 7/1999 | Griffin et al. | 363/37 |
| 6,177,768 | B1 * | 1/2001 | Kamata et al. | 315/241 R |
| 6,376,804 | B1 | 4/2002 | Ranish et al. | |
| 7,923,933 | B2 * | 4/2011 | Serebryanov et al. | 315/90 |
| 2003/0222588 | A1 | 12/2003 | Myron et al. | |
| 2008/0164822 | A1 * | 7/2008 | Serebryanov et al. | 315/129 |
| 2009/0272320 | A1 | 11/2009 | Wakalopulos | |

* cited by examiner

*Primary Examiner* — Douglas W Owens
*Assistant Examiner* — Henry Luong
(74) *Attorney, Agent, or Firm* — Patterson & Sheridan, LLP

(57) ABSTRACT

Apparatus and methods for detecting lamp failure in a rapid thermal processing (RTP) tool are provided. Lamp failure detection systems are provided that can accommodate DC and/or AC voltages. The systems sample voltage signals along a circuit path formed by at least two serially connected lamps, calculate a voltage drop across the first lamp of the at least two serially connected lamps based on the sampled voltage signals, and determine whether a lamp failure has occurred based on a relationship between the voltage drop across the first lamp and a total voltage applied to the circuit path.

8 Claims, 5 Drawing Sheets

LAMP FAILURE DETECTOR

BACKGROUND OF THE INVENTION

1. Field of the Invention

Embodiments of the present invention generally relate to apparatus and methods for detecting lamp failure, and more specifically for detecting lamp failure of serially connected lamps in a rapid thermal processing (RTP) tool.

2. Description of the Related Art

Rapid thermal processing (RTP) is any thermal processing technique that allows rapid heating and rapid cooling of a substrate such as a silicon wafer. The specific peak temperature and heating time used depend on the type of wafer processing. RTP wafer processing applications include annealing, dopant activation, rapid thermal oxidation, and silicidation among others. The rapid heating to relatively high temperatures followed by the rapid cooling that characterize RTP provides more precise wafer processing control. The trend for thinner oxides used in MOS gates has led to requirements of oxide thicknesses less than 100 Angstroms for some device applications. Such thin oxides require very rapid heating and cooling of the wafer surface in an oxygen atmosphere to grow such a thin oxide layer. RTP systems can provide this level of control, and are used for rapid thermal oxidation processing.

A result of the short heating cycle used in RTP is that any temperature gradients that may exist across the wafer surface can adversely affect wafer processing. It is, therefore, desired in RTP to monitor the temperature across the wafer surface and improve temperature uniformity in and on the wafer surface during processing. As a result, the placement, control, and monitoring of individual heating elements is designed so that the heat output can be controlled to help improve temperature uniformity across the wafer surface.

However, current approaches will not usually produce the temperature uniformity needed. Variation in heat intensity due to element failure or poor performance can greatly compromise the desired temperature profile control and result in unacceptable process results. Accordingly, a monitoring system that can detect failure or unacceptable element performance during wafer processing is a useful feature for an RTP system.

Therefore, there is a need for an improved apparatus and method for heating element failure detection. Further, a failure detection system that is independent of voltage and current waveforms is needed. A failure detection system that can identify which element has failed is also needed.

SUMMARY OF THE INVENTION

Embodiments of the present invention generally relate to apparatus and methods for detecting lamp failure, and more specifically for detecting lamp failure of serially connected lamps in a rapid thermal processing (RTP) tool.

In one embodiment, the system generally comprises a chamber body having an opening, a lamphead assembly coupled to the opening of the chamber body, the lamphead assembly comprising a plurality of lamps arranged in an array, and a lamp failure detector electrically coupled to the lamphead assembly. The lamp failure detector generally comprises a voltage data acquisition module positioned to sample voltage signals on a circuit path formed by at least two serially connected lamps of the plurality of lamps, a first capacitor coupled to the circuit path at a first node associated with a first lamp of the at least two serially connected lamps and coupled to the voltage data acquisition module, a second capacitor coupled to the circuit path at a second node associated with the first lamp of the at least two serially connected lamps and coupled to the voltage data acquisition module, and a controller adapted to receive digital values of the sampled voltage signals from the voltage data acquisition module, and to determine a status of one or more lamps of the at least two serially connected lamps based on a voltage drop across the first lamp of the at least two serially connected lamps, as determined by the sampled voltage signals.

In another embodiment, the system generally comprises a chamber body having an opening, a lamphead assembly coupled to the opening of the chamber body, the lamphead assembly comprising a plurality of lamps arranged in an array, and a lamp failure detector electrically coupled to the lamphead assembly. The lamp failure detector generally comprises a voltage data acquisition module positioned to sample voltage signals on a circuit path formed by at least two serially connected lamps of the plurality of lamps, a first capacitor coupled to the circuit path at a first node associated with a first lamp of the at least two serially connected lamps and coupled to the voltage data acquisition module, a second capacitor coupled to the circuit path at a second node associated with the first lamp of the at least two serially connected lamps and coupled to the voltage data acquisition module, wherein the circuit path and the first and second capacitors are part of a lamp circuit board, and wherein the at least two serially connected lamps are coupled to the lamp circuit board, and a controller adapted to receive digital values of the sampled voltage signals from the voltage data acquisition module, and to determine a status of one or more lamps of the at least two serially connected lamps based on a voltage drop across the first lamp of the at least two serially connected lamps, as determined by the sampled voltage signals.

In another embodiment, a method for detecting lamp failure in lamps used for thermal processing of semiconductor substrates generally comprises sampling voltage signals along a circuit path formed by at least two serially connected lamps, wherein the voltage signals are sampled at nodes of a first lamp of the at least two serially connected lamps, determining a voltage drop across the first lamp of the at least two serially connected lamps based on the sampled voltage signals, and determining lamp failure based on a relationship between the voltage drop across the first lamp and a total voltage drop of the circuit path.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention generally relate to apparatus and methods for detecting lamp failure, and more specifically for detecting lamp failure of serially connected lamps in a rapid thermal processing (RTP) tool.

Figure 1:
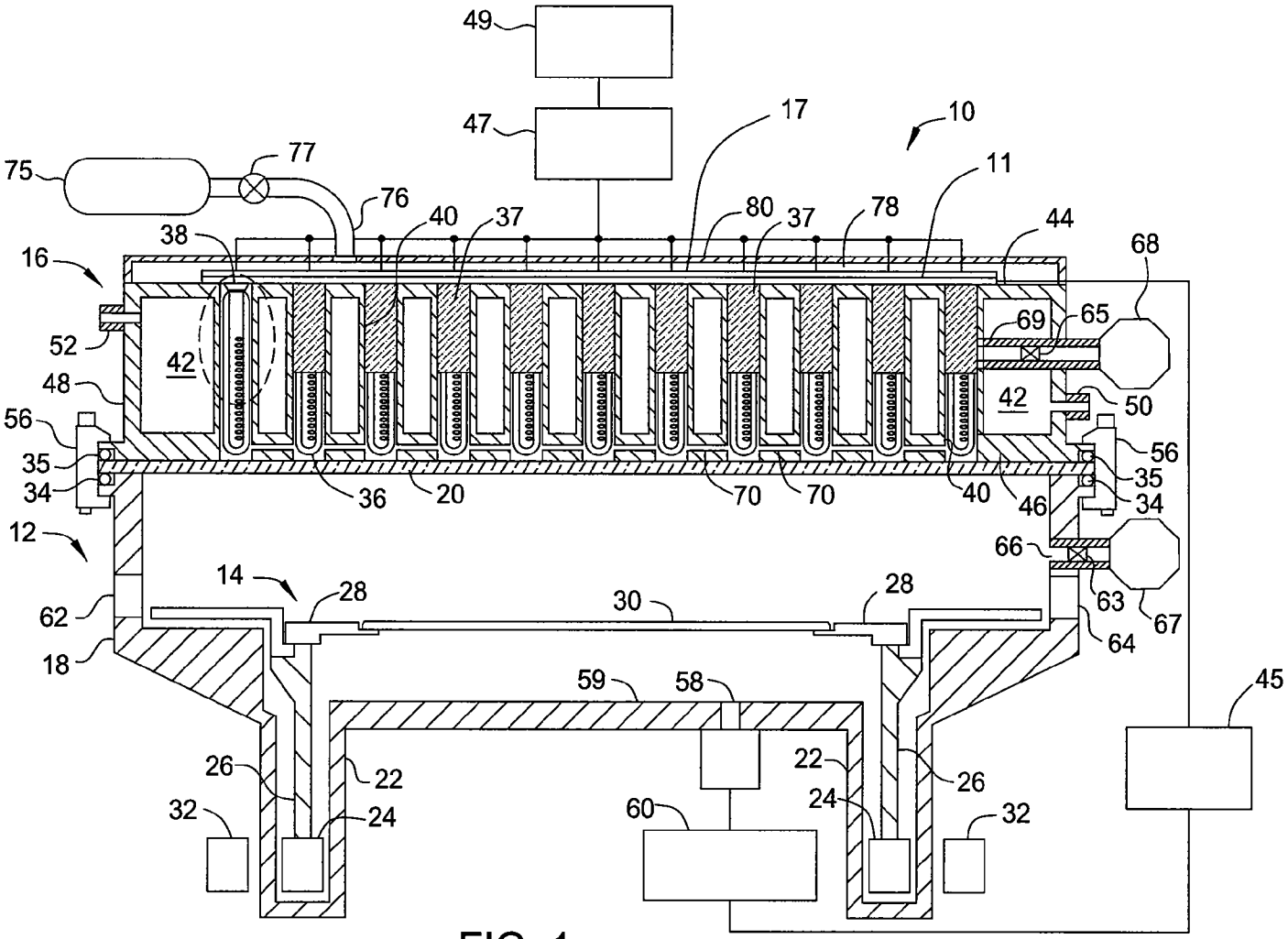
FIG. 1 illustrates a partial cross-sectional view of a semiconductor processing system according to one embodiment.

FIG. 1 illustrates a partial cross-section of a semiconductor processing system 10 according to one embodiment. The semiconductor processing system 10 may generally include a semiconductor processing chamber 12, a wafer handling or support apparatus 14 located within the semiconductor processing chamber 12, and a lamphead or heat source assembly 16 located on the semiconductor processing chamber.

The semiconductor processing chamber 12 includes a main body 18 and a window 20 resting on an upper edge of the main body 18. An o-ring 34 is located between the window 20 and the main body 18 to provide an air-tight seal at the interface. The window 20 may be made of a material that is transparent to infrared light. For example, the window 20 may be made of clear fused silica quartz. The main body 18 may be made of stainless steel and may be lined with quartz (not shown). A circular channel 22 forms part of a base of the main body 18.

The main body 18 of the processing chamber 12 includes a processing gas inlet port 62 and a gas outlet port 64. In use, the pressure within the processing chamber 12 can be reduced to a sub-atmospheric pressure prior to introducing a process gas through the inlet port 62. The process chamber 12 is evacuated by pumping through a conduit or port 66 by means of a vacuum pump 67 and a valve 63. The pressure is typically reduced to between about 1 torr and 160 torr. Certain processes may be run at atmospheric pressure.

The window 20 is disposed between the lamphead assembly 16 and the main body 18. An o-ring 35 is located between the window 20 and the lamphead assembly 16 to provide an airtight seal at that interface. Clamps 56 secure the window 20, the lamphead assembly 16, and the process chamber 12 to one another. In other embodiments, the lamphead assembly 16 may be arranged at an underside of the main body 18 to heat a backside of a wafer or substrate 30. The main body 18 may be at least partially constructed of quartz, or another transparent material, to allow radiation emitted from the lamphead assembly 16 to contact the backside of the substrate 30. The main body 18 may be further adapted to allow for clamping or securing of the lamphead assembly 16 to the underside thereof while maintaining a sealed environment.

The lamphead assembly 16 includes a plurality lamps 36 that are supported by electrical sockets 38. The electrical sockets 38 may be connected to a circuit board 11 used for power distribution. The lamps 36 may be infrared radiation emitting light bulbs. Each lamp 36 may be potted inside a recess 40 with a ceramic potting compound 37. The potting compound 37 may be relatively porous and formed from magnesium phosphate. The potting compound 37 may also be white so as to reflect radiation emitted from the lamps 36. The recesses 40 may be reflective and/or may be lined with a reflective material, such as, for example, gold or stainless steel. The open end of the recesses 40, as shown, are located adjacent window 20 to allow radiation emitted from the lamps 36 to enter the semiconductor processing chamber 12.

Figure 2A:
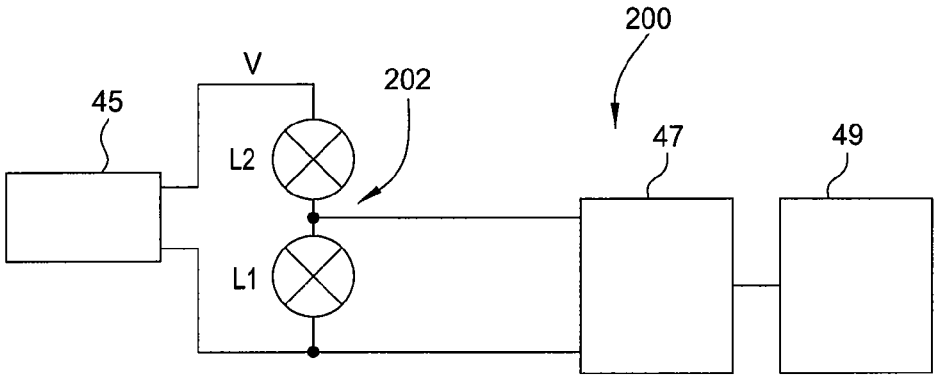
FIG. 2A illustrates a schematic view of a lamp failure detection system according to one embodiment.
Figure 2B:
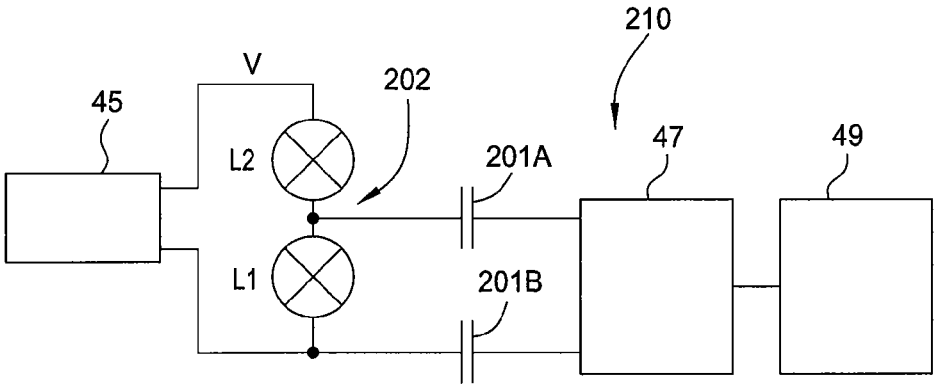
FIG. 2B illustrates a schematic view of a lamp failure detection system according to one embodiment.

The lamps 36 may be arranged in an array within the lamphead assembly 16 so as to evenly distribute heat within the semiconductor processing chamber 12. The lamps 36 and sockets 38 may be connected to the circuit board 11 such that an array of circuits connected in parallel is created where each circuit consists of a pair of serially connected lamps L1, L2, as shown in FIGS. 2A-2B.

The lamphead assembly 16 may include a cooling chamber 42 defined by an upper chamber wall 44, a lower chamber wall 46, a cylindrical wall 48, and the recesses 40. A coolant fluid, such as water or a gas, is introduced into the cooling chamber 42 via an inlet 50 and is removed at an outlet 52. The coolant fluid travels between the recesses 40 and serves to cool the recesses 40.

A vacuum pump 68 may be provided to reduce the pressure within the lamphead assembly 16. The pressure within the lamphead assembly 16 is reduced by pumping through a conduit or port 69, including a valve 65, which extends through the cooling chamber 42 and is in fluid communication with an interior space of the recesses 40. The interior spaces of the recesses 40 may be in fluid communication with one another via small passageways 70, which extend through the walls of the recesses 40.

A pressurized source of a thermally conductive gas 75, such as helium, may be provided to fill the lamphead assembly 16 with the thermally conductive gas. The source 75 is connected to the lamphead assembly 16 by means of a port or conduit 76 and a valve 77. The thermally conductive gas is introduced into a space 78 formed between a lamphead cover 80 and the upper chamber wall 44 which evenly distributes the thermally conductive gas within the lamphead assembly 16. Opening the valve 77 causes the thermally conductive gas to flow into the space 78. The valve 77 may remain open until the lamphead assembly 16 is substantially filled with the thermally conductive gas. Since the lamp potting compound 37 is porous, the thermally conductive gas flows through the potting compound 37 and into the recesses 40 to cool the lamps 36. In one embodiment, the lamphead assembly 16 is not evacuated, and the thermally conductive gas from is introduced to the lamphead assembly 16 through an inlet port (not shown) and exhausted through an exhaust port (not shown) to maintain a flow of the thermally conductive gas through the lamphead assembly 16.

The wafer handling apparatus 14 may include a magnetic rotor 24 positioned within the channel 22, a tubular support 26 resting on or otherwise coupled to the magnetic rotor 24 and positioned within the channel 22, and an edge ring 28 resting on the tubular support 26. The tubular support 26 may be made of quartz. The edge ring 28 may be formed from silicon carbide graphite and may be coated with silicon. During processing, a wafer or substrate 30 rests on the edge ring 28. A magnetic stator 32 may be located externally of the channel 22 and is used to magnetically induce rotation of the magnetic rotor 24, through the main body 18, thereby causing rotation of the tubular support 26 and edge ring 28.

Sensors, such as one or more pyrometers 58, are located in a reflective lower wall 59 of the main body 18 and are positioned to detect a temperature of a lower surface of a wafer 30 positioned in the edge ring 28. The pyrometers 58 may be connected to a power supply controller 60, which controls the power supplied by the power supply 45 to the lamps 36 in response to a measured temperature.

In operation, power, such as AC or DC power, is supplied to the power distribution circuit board 11 by the power supply 45 and is distributed to the lamps 36. A measurement circuit board 17 may be connected to the circuits of the power distribution board 11 for data acquisition and lamp failure detection purposes. A data acquisition unit (DAQ) 47 may be connected to the measurement circuit board 17. The DAQ 47 measures voltages across the lamps 36 and feeds the voltage data to a processor/controller 49 which uses the data to determine if there is a failure in any of the lamps 36.

FIG. 2A illustrates a schematic view of a lamp failure detection system 200. The system 200 includes the DAQ 47 and the processor/controller 49. The lamp failure detection system 200 may be used in conjunction with AC and/or DC power supplies. FIG. 2B illustrates a schematic view of a lamp failure detection system 210. The system 210 includes the DAQ 47, the processor/controller 49, and a pair of capacitors 201A, 201B. The lamp failure detection system 210 may be used in conjunction with AC power supplies.

Referring now to FIGS. 1, 2A, and 2B, as described above, the lamps 36 may be distributed into circuit paths 202 of pairs of serially connected lamps L1, L2. The DAQ 47 of the lamp failure detection system 200 may be coupled to the circuit path 202 formed by the lamps L1, L2. The capacitors 201A, 201B of the lamp failure detection system 210 may be coupled between the circuit path 202 formed by the lamps L1, L2 and the DAQ 47. The capacitors 201A, 201B may attenuate the voltage (V) supplied to the circuit path 202 by the power supply 45. For example, the power supply 45 may be configured to supply 200V to the circuit path 202, and the DAQ 47 may be configured to measure a maximum of only 5V. The capacitors 201A, 201B attenuate the voltage down to a readable level for the DAQ 47. The use of capacitors 201A, 201B may be additionally beneficial if the ground of the power supply 45 is at a different potential from the ground of the DAQ 47.

Figure 3:
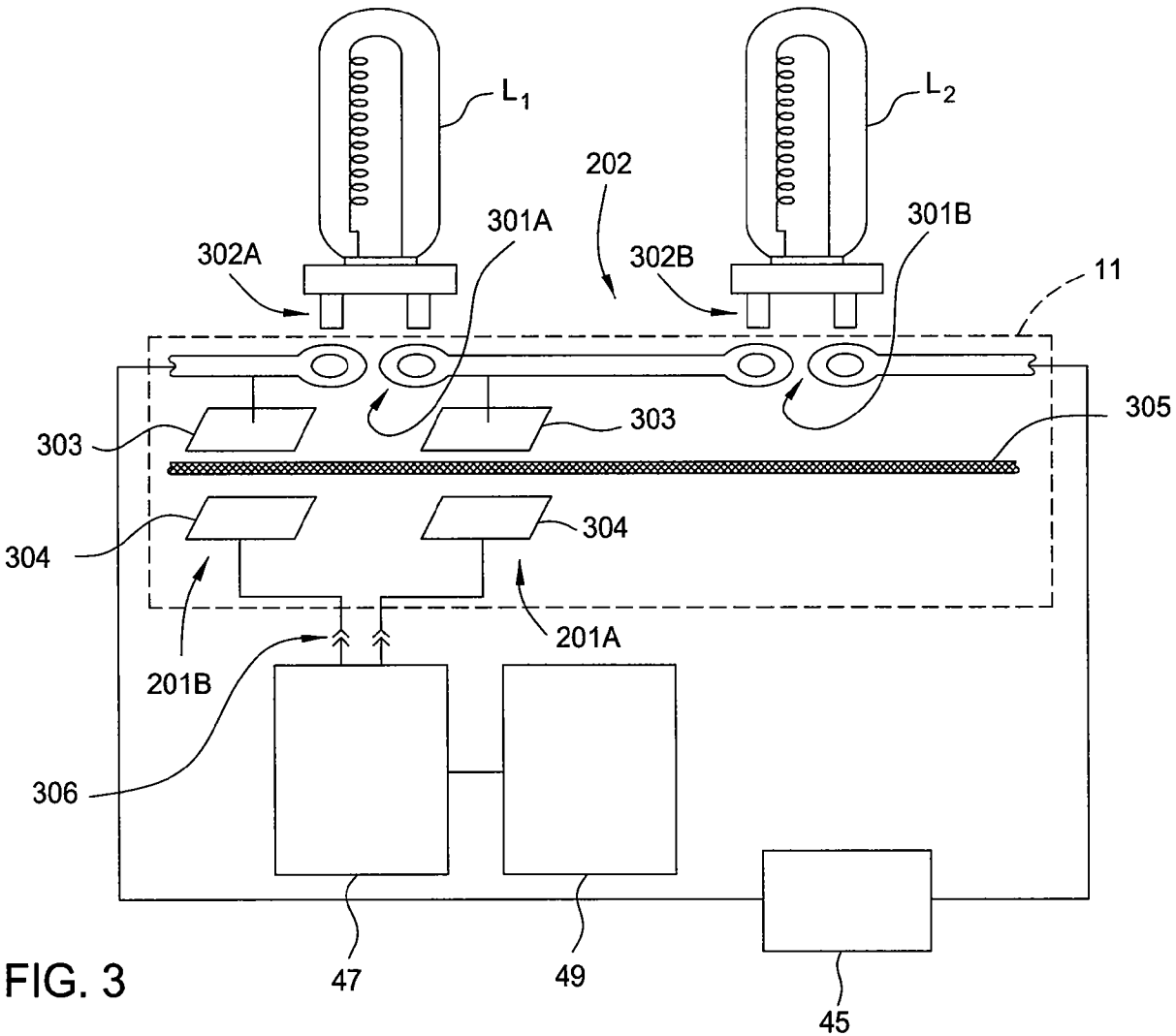
FIG. 3 illustrates a partial cross-sectional view of a circuit board used in the lamp failure detection system of FIG. 2B according to one embodiment.

The pair of capacitors 201A and 201B may be part of the power distribution circuit board 11 as shown in the partial cross-sectional view of the power distribution circuit board 11 in FIG. 3. Referring now to FIGS. 1-3, a pair of terminal sets 301A, 301B are arranged on the circuit board 11 to create the circuit path 202 for the pair of serially connected lamps L1, L2. The terminals 301A, 301B are sized and positioned to receive connectors 302A, 302B of the lamps L1, L2, respectively. The pair of capacitors 201A, 201B may also be arranged within the power distribution circuit board 11. The capacitors 201A, 201B may be parallel plate capacitors comprising a first plate 303 and a second plate 304 separated by a dielectric material 305 of the power distribution circuit board 11. The first plate 303 of the capacitor 201A may be connected to one of the terminals of the terminal set 301A, and the first plate 303 of the capacitor 201B may be connected to the other terminal of the terminal set 301A. A connector 306 may be used to connect the capacitors 201A, 201B of the power distribution circuit board 11 with the DAQ 47.

Figure 4:
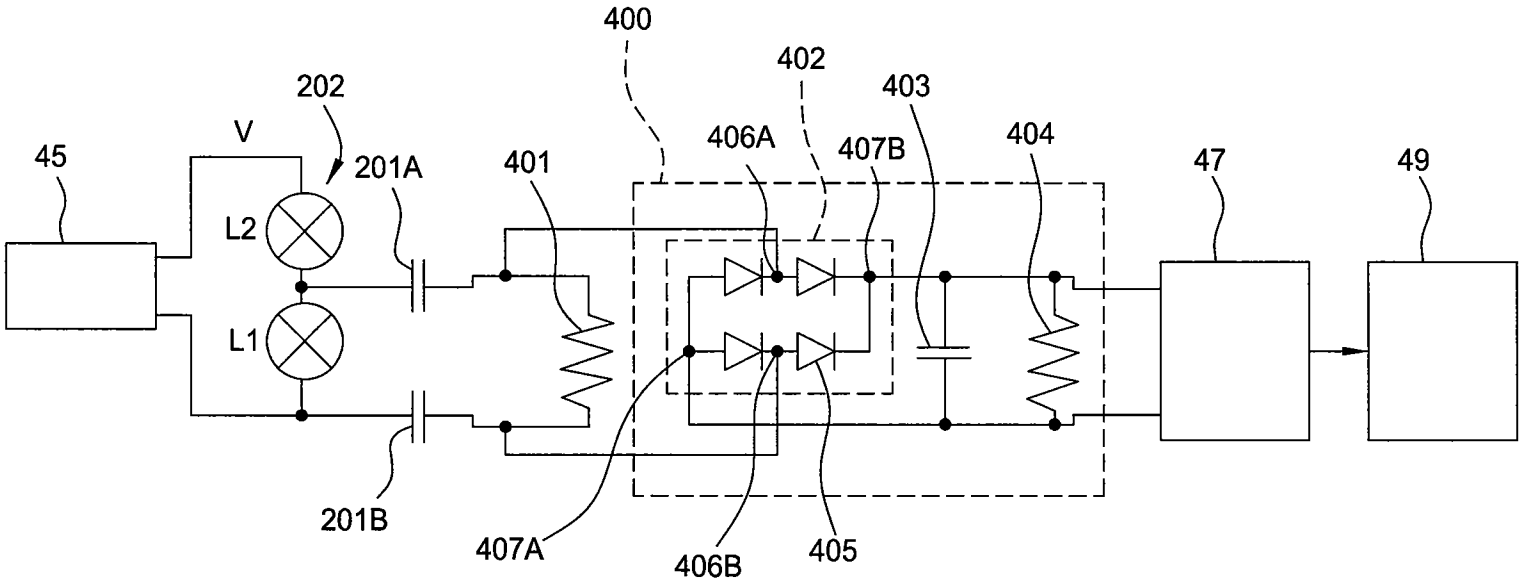
FIG. 4 illustrates a schematic view of a lamp failure detection system according to another embodiment.

It may be useful to rectify the voltage signals sampled by the DAQ 47, especially when AC power is supplied by the power supply 45, so that accurate measurement is possible for lamp failure detection. One embodiment of a filter rectifier 400 usable in the embodiments of FIGS. 1-3 is shown in FIG. 4. An attenuation resistor 401 may be coupled between the capacitors 201A, 201B in parallel with the lamp L1. The attenuation resistor 401 may define an attenuation between the capacitors 201A, 201B and may have a resistance value much greater, for example an order of magnitude greater, than a resistance value of the lamp L1 so as not to affect the measurements taken by the DAQ 47 during normal operation.

The filter rectifier 400 may generally comprise a bridge rectifier 402, a measurement capacitor 403, and a bleeding resistor 404. The bridge rectifier may comprise four diodes 405. The diodes 405 may be formed as a single unit or may be discrete components coupled together. The bridge rectifier 402 has ends 406A, 406B. The attenuation resistor 401 may be coupled in parallel with the ends 406A, 406B of the bridge rectifier 402. The bridge rectifier 402 also has taps 407A, 407B coupled in parallel with the measurement capacitor 403. The bleeding resistor 404 may be coupled in parallel with the measurement capacitor 403 and also coupled to the DAQ 47. The filter rectifier 400 shown rectifies the voltages supplied by the power supply 45 and may serve to additionally attenuate the high voltage so that the voltage signals are readable by the DAQ 47.

Figure 5:
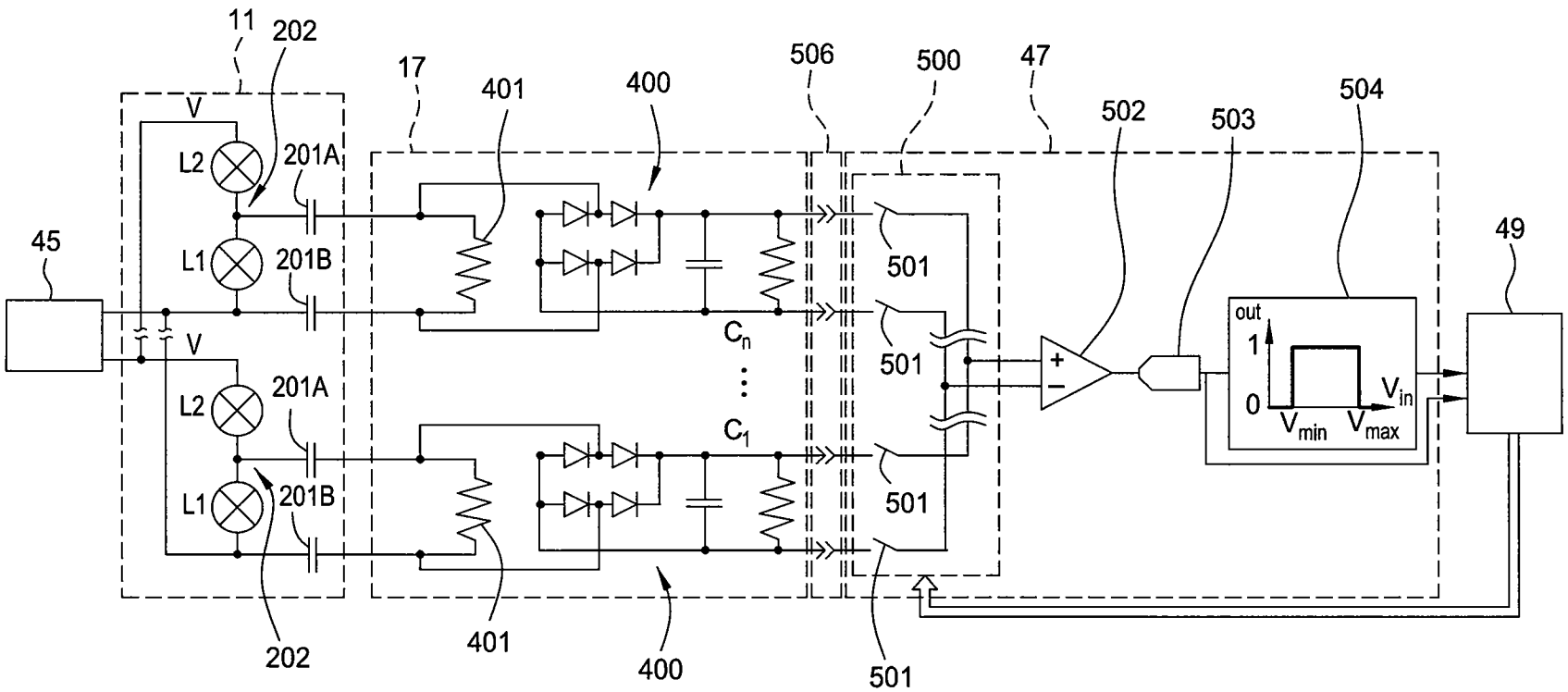
FIG. 5 illustrates a schematic view of a lamp failure detection system according to another embodiment.

Referring to FIG. 5, a plurality of circuits $C_1$-$C_n$ are shown where n is between 2 and 200. Each of the circuits $C_1$-$C_n$ comprises a circuit path 202 having a pair of serially connected lamps L1, L2, a pair of capacitors 201A, 201B, an attenuation resistor 401, and a filter rectifier 400. The circuits $C_1$-$C_n$ may be connected to a single high efficiency connector 506. The connector 506 may be connected with a multiplexor (MUX) 500 which may be part of the DAQ 47. The MUX 500 comprises a plurality of switches 501 which may be controlled by the controller 49 to selectively measure the voltage signals of the circuits $C_1$-$C_n$. The switches 501 of the MUX 500 may be connected to a differential amplifier 502. The differential amplifier 502 combines the voltage signals supplied by the capacitors 201A, 201B into a single output voltage defining a voltage drop across the lamp L1. The output voltage is a difference of the voltage signals from the capacitors 201A, 201B as attenuated and rectified by the filter rectifier 400 which may also be amplified by the differential amplifier 502. The output voltage may be amplified by a value depending on the maximum voltage readable by the DAQ 47 and the attenuation of the voltage signals from the capacitors 201A, 201B and the filter rectifier 400. For example, the output voltage may be amplified by a value between 0.1 and 5. In one embodiment, the output voltage is amplified by a value of 1. The differential amplifier 502 may also limit noise in the voltage signals.

The output of the differential amplifier 502 may be coupled to an analog to digital converter (ADC) 503. The ADC 503 may convert the analog voltage signals received by the MUX 500 into binary signals which are readable by the controller 49. In one embodiment, the ADC 503 may output signals in 8-bit binary or higher, such as 10-bit binary. The output of the ADC 503 may be coupled to a window comparator 504. The use of the window comparator 504 may be particularly beneficial where there is high signal noise or in AC voltage applications due to the fluctuations in the signal. In the embodiment shown in FIG. 5 the window comparator 504 may be a physical component used to perform the functions described above. In another embodiment, the functions performed by the window comparator 504 may be accomplished by an algorithm programmed into the controller 49, in which case the ADC 503 would be directly connected to the controller 49.

The window comparator 504 may be a digital device which receives the output voltage from the ADC 503 and provides a digital output voltage based on the output voltage from the ADC 503. For example, if the output voltage from the ADC 503 is within a certain range, between $V_{min}$ and $V_{max}$, the window comparator 504 will output a value of TRUE (1) in binary code readable by the controller. If the output voltage from the ADC 503 is outside the range the window comparator 504 will output a value of FALSE (0) in binary code readable by the controller. Other outputs from the window comparator 504 are possible. A first range representative of the total voltage applied to the circuit path 202 may be defined by the maximum voltage readable by the DAQ 47. A second threshold range defined by $V_{min}$ and $V_{max}$ may be within the first range. In one embodiment, the maximum readable voltage of the DAQ 47 is 5V, $V_{min}$ is 1V, and $V_{max}$ is 4V. In an alternative embodiment, the window comparator 504 may be an analog device and may be positioned before the ADC 503 so that the output of the window comparator 504 is turned into a digital value by the ADC 503.

With respect to lamp failure, the output of the window comparator 504 may be used to signal the status of the lamps L1, L2 to the controller 49. For example, if the output of the window comparator 504 is TRUE then both lamps L1, L2 in the circuit path 202 are operational. If the output of the window comparator 504 is FALSE then lamp failure has occurred. Additionally or alternatively, comparison by the controller 49 of the voltage output by the ADC 503 may be used to determine which of the lamps L1, L2 has failed. In one embodiment, if the voltage output by the ADC 503 is greater than $V_{max}$ then the lamp L1 is in an open state. If the voltage output by the ADC 503 is less than $V_{min}$ then the lamp L2 is in an open state. In another embodiment, if the voltage output by the ADC 503 is equal to the total voltage applied to the circuit path, as attenuated and rectified, then the lamp L1 is in an open state. If the voltage output by the ADC 503 is equal to zero then the lamp L2 is in an open state. The phrase "equal to" is not limited to exactly equal to or with unlimited precision due to losses within the circuit and fluctuations in power.

The circuit paths 202 represented in FIGS. 2-5 may be configured with more than two lamps in series. In cases where there are more than two lamps, lamp failure can be detected based on a difference between the voltage drop across the first lamp and a value of the total voltage applied to the circuit path 202 proportionate to the total number of lamps in the circuit path 202. For example, for three lamps arranged in series on the circuit path 202, the voltage drop across a first lamp in the series should be approximately ⅓ of the total voltage applied to the circuit path 202 when all lamps are operational. The values may be approximate or within a threshold range to account for losses and fluctuations in the circuit path 202, imprecisions in measurement, and voltage variations when using AC power.

Thus, a lamp failure detector is described which can effectively determine lamp failure and which is usable in systems with differing ground potentials.

While the foregoing is directed to embodiments of the present invention, other and further embodiments of the invention may be devised without departing from the basic scope thereof, and the scope thereof is determined by the claims that follow.

The invention claimed is:

1. An apparatus for thermal processing of semiconductor substrates, comprising:

a chamber body having an opening;

a lamphead assembly coupled to the opening of the chamber body, the lamphead assembly comprising a plurality of lamps arranged in an array; and a lamp failure detector electrically coupled to the lamphead assembly and comprising:

a voltage data acquisition module positioned to sample alternating current (AC) voltage signals on a circuit path formed by at least two serially connected lamps of the plurality of lamps;

a first capacitor coupled to the circuit path at a first node associated with a first lamp of the at least two serially connected lamps and coupled to the voltage data acquisition module; and a second capacitor coupled to the circuit path at a second node associated with the first lamp of the at least two serially connected lamps and coupled to the voltage data acquisition module; and a controller adapted to receive digital values of the sampled voltage signals from the voltage data acquisition module, and to determine a status of one or more lamps of the at least two serially connected lamps based on a voltage drop across the first lamp of the at least two serially connected lamps, as determined by the sampled voltage signals, wherein the lamp failure detector further comprises a first resistor coupled between the first and second capacitors of each circuit path in parallel with the first lamp and a filter rectifier coupled to the first resistor, the filter rectifiers each comprising:

a bridge rectifier having ends coupled in parallel with the first resistor;

a measurement capacitor coupled in parallel with taps of the bridge rectifier; and a second resistor coupled in parallel with the measurement capacitor and coupled to the voltage data acquisition module.

2. The apparatus of claim 1, wherein the plurality of lamps are connected in a plurality of circuit paths, each circuit path comprising at least two serially connected lamps, wherein each circuit path further comprises a first and second capacitor coupled to the circuit path at first and second nodes of a first lamp of the at least two serially connected lamps respectively, and wherein the first and second capacitors of each circuit path are coupled to the voltage data acquisition module.

3. The apparatus of claim 2, wherein the voltage data acquisition module comprises:

a multiplexor coupled to the second resistor of each filter rectifier; and an analog to digital converter coupled to the multiplexor and the controller, wherein the controller is further adapted to control switches of the multiplexor to select different circuit paths for sampling the voltage signals.

4. The apparatus of claim 3, wherein the voltage data acquisition module further comprises:

a differential amplifier coupled to the multiplexor and the analog to digital converter; and a window comparator coupled to the analog to digital converter and coupled to the controller.

5. An apparatus for thermal processing of semiconductor substrates, comprising:

a chamber body having an opening;

a lamphead assembly coupled to the opening of the chamber body, the lamphead assembly comprising a plurality of lamps arranged in an array; and a lamp failure detector electrically coupled to the lamphead assembly and comprising:

a voltage data acquisition module positioned to sample alternating current (AC) voltage signals on a circuit path formed by at least two serially connected lamps of the plurality of lamps;

a first capacitor coupled to the circuit path at a first node associated with a first lamp of the at least two serially connected lamps and coupled to the voltage data acquisition module; and a second capacitor coupled to the circuit path at a second node associated with the first lamp of the at least two serially connected lamps and coupled to the voltage data acquisition module, wherein the circuit path and the first and second capacitors are part of a lamp circuit board, and wherein the at least two serially connected lamps are coupled to the lamp circuit board; and a controller adapted to receive digital values of the sampled voltage signals from the voltage data acquisition module, and to determine a status of one or more lamps of the at least two serially connected lamps based on a voltage drop across the first lamp of the at least two serially connected lamps, as determined by the sampled voltage signals, wherein the lamp failure detector further comprises a first resistor coupled between the first and second capacitors of each circuit path in parallel with the first lamp and a filter rectifier coupled to the first resistor, the filter rectifiers comprising:

a bridge rectifier having ends coupled in parallel with the first resistor;

a third capacitor coupled in parallel with taps of the bridge rectifier; and a second resistor coupled in parallel with the third capacitor and coupled to the voltage data acquisition module, wherein the filter rectifiers are part of a measurement circuit board.

6. The apparatus of claim 5, wherein the plurality of lamps are connected in a plurality of circuit paths, each circuit path comprising at least two serially connected lamps, wherein each circuit path further comprises a first and second capacitor coupled to the circuit path at first and second nodes of a first lamp of the at least two serially connected lamps respectively, and wherein the first and second capacitors of each circuit path are coupled to the voltage data acquisition module.

7. The apparatus of claim 6, wherein the voltage data acquisition module comprises:

a multiplexor coupled to the second resistor of each filter rectifier; and an analog to digital converter coupled to the multiplexor and the controller, wherein the controller is further adapted to control the multiplexor to receive voltage signals from a selected circuit.

8. The apparatus of claim 7, wherein the voltage data acquisition module further comprises:

a differential amplifier coupled to the multiplexor and the analog to digital converter; and a window comparator coupled to the analog to digital converter and coupled to the controller.

* * * * *